US011537060B1

(12) United States Patent
Hara et al.

(10) Patent No.: US 11,537,060 B1
(45) Date of Patent: Dec. 27, 2022

(54) IMAGE FORMING APPARATUS

(71) Applicant: FUJIFILM Business Innovation Corp., Tokyo (JP)

(72) Inventors: Kenji Hara, Yokohama (JP); Yuma Motegi, Yokohama (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 0 days.

(21) Appl. No.: 17/545,266

(22) Filed: Dec. 8, 2021

(30) Foreign Application Priority Data

Aug. 25, 2021 (JP) ..... JP2021-137639

(51) Int. Cl.
*G03G 15/043* (2006.01)
*G03G 15/00* (2006.01)

(52) U.S. Cl.
CPC ..... *G03G 15/043* (2013.01); *G03G 15/5058* (2013.01)

(58) Field of Classification Search
CPC ..... G03G 15/043; G03G 15/5041; G03G 15/5054; G03G 15/5058; G03G 15/5062
See application file for complete search history.

(56) References Cited

U.S. PATENT DOCUMENTS 9,696,673 B2 * 7/2017 Omura ..... G03G 15/043
2014/0294413 A1 * 10/2014 Tanaka ..... G03G 21/08 399/128
2015/0003853 A1 * 1/2015 Nakagawa ..... G03G 15/5058 399/49
2018/0059569 A1 * 3/2018 Matsuura ..... G03G 15/043

FOREIGN PATENT DOCUMENTS

JP 2012-22101 A 2/2012

* cited by examiner

*Primary Examiner* — Carla J Therrien
(74) *Attorney, Agent, or Firm* — Oliff PLC

(57) ABSTRACT

An image forming apparatus includes: an image carrier that carries an image developed by a developer; an exposure part that has plural light-emitting parts that are shifted from one another so as to face the image carrier and in each of which plural light-emitting elements are aligned and forms an electrostatic latent image on the image carrier by exposing the image carrier to light; and plural density detection parts that are disposed at positions corresponding to substantially central positions of the plural light-emitting parts and at positions corresponding to end portions closer to end portions of the image carrier among end portions of two light-emitting parts disposed close to the end portions of the image carrier among the plural light-emitting parts and detect a density of an image obtained by developing the electrostatic latent image on the image carrier.

20 Claims, 12 Drawing Sheets

IMAGE FORMING APPARATUS

CROSS-REFERENCE TO RELATED APPLICATIONS

This application is based on and claims priority under 35 USC 119 from Japanese Patent Application No. 2021-137639 filed Aug. 25, 2021.

BACKGROUND

(i) Technical Field

The present disclosure relates to an image forming apparatus.

(ii) Related Art

Japanese Unexamined Patent Application Publication No. 2012-022101 discloses an image forming apparatus that generates a synthesis value by synthesizing values of density unevenness for respective factors causing density unevenness in an image corresponding to a synchronous timing for the factors from values of density unevenness for the respective factors extracted corresponding to a synchronous timing for the factors from first density unevenness distribution information indicative of a two-dimensional distribution of density unevenness for the respective factors and controls image data or an exposure amount of an exposure device based on the synthesis value so that density unevenness corresponding to a synchronous timing for the factors is not generated.

SUMMARY

Aspects of non-limiting embodiments of the present disclosure relate to an image forming apparatus that makes it possible to reduce the number of density detection parts for detecting a density of an image without deteriorating accuracy of density fluctuation correction in a case where an exposure unit includes plural light-emitting parts, as compared with a case where equal numbers of density detection parts are provided for the plural light-emitting parts.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided an image forming apparatus including: an image carrier that carries an image developed by a developer; an exposure part that has plural light-emitting parts that are shifted from one another so as to face the image carrier and in each of which plural light-emitting elements are aligned and forms an electrostatic latent image on the image carrier by exposing the image carrier to light; and plural density detection parts that are disposed at positions corresponding to substantially central positions of the plural light-emitting parts and at positions corresponding to end portions closer to end portions of the image carrier among end portions of two light-emitting parts disposed close to the end portions of the image carrier among the plural light-emitting parts and detect a density of an image obtained by developing the electrostatic latent image on the image carrier.

BRIEF DESCRIPTION OF THE DRAWINGS

Exemplary embodiments of the present disclosure will be described in detail based on the following figures, wherein.

DETAILED DESCRIPTION

Next, an exemplary embodiment of the present disclosure is described in detail with reference to the drawings.

Figure 1:
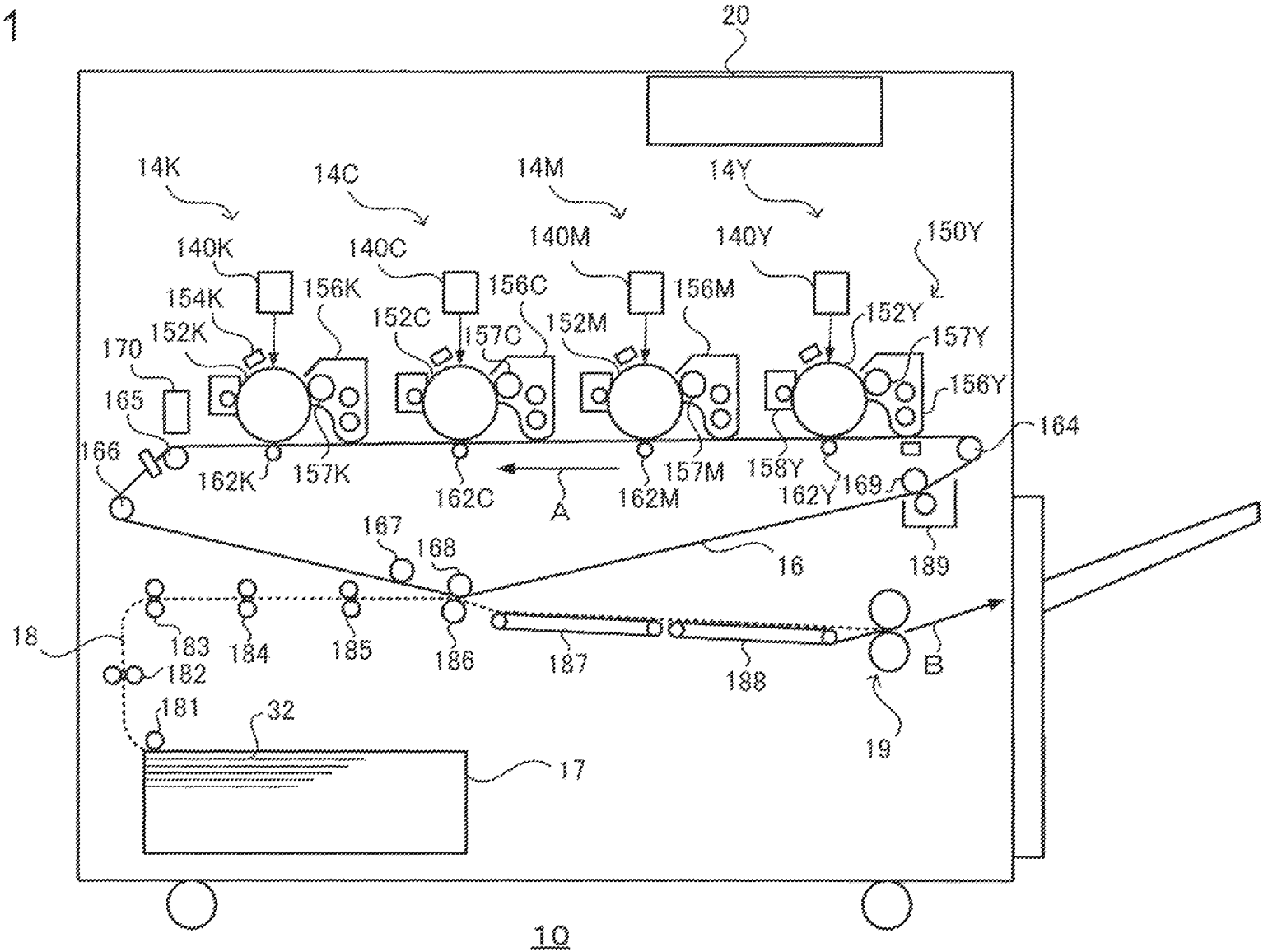
FIG. 1 illustrates a configuration of an image forming apparatus according to an exemplary embodiment of the present disclosure.

FIG. 1 illustrates a configuration of an image forming apparatus 10 according to the exemplary embodiment of the present disclosure.

As illustrated in FIG. 1, the image forming apparatus 10 includes image forming units 14K, 14C, 14M, and 14Y, an intermediate transfer belt 16, a sheet tray 17, a sheet transport path 18, a fixing unit 19, and a controller 20. The image forming apparatus 10 has a printer function of printing image data received from a personal computer (not illustrated) or the like.

First, an outline of the image forming apparatus 10 is described. The controller 20 is provided in an upper portion of the image forming apparatus 10. The controller 20 performs image processing such as tone correction and resolution correction on image data input from a personal computer (not illustrated) or the like over a network line such as a LAN and outputs the image data to the image forming units 14.

Below the controller 20, the four image forming units 14K, 14C, 14M, and 14Y are provided corresponding to colors that constitute a color image. In the present exemplary embodiment, the four image forming units 14K, 14C, 14M, and 14Y are provided corresponding to black (K), cyan (C), magenta (M), and yellow (Y) so as to be arranged horizontally at constant intervals along the intermediate transfer belt 16. The intermediate transfer belt 16 serves as an intermediate transfer body and rotationally moves in a direction indicated by arrow A in FIG. 1. These four image forming units 14K, 14C, 14M, and 14Y sequentially form toner images of the respective colors based on image data input from the controller 20 and transfer (first transfer) these toner images onto the intermediate transfer belt 16 at such timings that these toner images are superimposed on one another. Note that an order of the colors of the image forming units 14K, 14C, 14M, and 14Y is not limited to the order of black (K), cyan (C), magenta (M), and yellow (Y) and may be any order such as an order of yellow (Y), magenta (M), cyan (C), and black (K).

The sheet transport path 18 is provided below the intermediate transfer belt 16. Recording paper 32 fed from the sheet tray 17 is transported on the sheet transport path 18. Onto the recording paper 32, the toner images of the respective colors transferred onto the intermediate transfer belt 16 so as to be superimposed on one another are collectively transferred (second transfer). The transferred toner images are fixed by the fixing unit 19 and is then discharged to an outside along arrow B.

Next, each constituent element of the image forming apparatus 10 is described in more detail.

The controller 20 performs predetermined image processing such as shading correction, brightness/color space conversion, and gamma correction on input image data. Note that in a case where the input image data is, for example, data of red (R), green (G), and blue (B) (each of which is 8 bits), the input image data is converted into document color material tone data of four colors of black (K), cyan (C), magenta (M), and yellow (Y) (each of which is 8 bits) by the image processing of the controller 20.

The image forming units 14K, 14C, 14M, and 14Y (image forming units) are disposed in parallel at constant intervals in a horizontal direction and have almost similar configurations except for that colors of formed images are different. The following describes the image forming unit 14K. Note that the configurations of the image forming units 14 are distinguished by the signs K, C, M, and Y.

The image forming unit 14K has an exposure part 140K that radiates light according to image data input from the controller 20 and an image forming device 150K on which an electrostatic latent image is formed by laser light scanned by the exposure part 140K.

The exposure part 140K exposes a photoreceptor roller 152K of the image forming device 150K to light by irradiating the photoreceptor roller 152K with laser light according to image data of black (K) and thereby forms an electrostatic latent image on the photoreceptor roller 152K. Note that the exposure part 140K includes plural bar-shaped LED print heads (LPHs) in each of which plural LEDs, which are light-emitting elements, are aligned. Details of the configuration of the exposure part 140K will be described later.

The image forming device 150K includes the photoreceptor roller 152K that rotates at a predetermined rotation speed along a direction indicated by arrow A, a charging device 154K serving as a charging unit that uniformly charges a surface of the photoreceptor roller 152K, a developing device 156K that develops an electrostatic latent image formed on the photoreceptor roller 152K, and a cleaning device 158K. The photoreceptor roller 152K is an image carrier having a cylindrical shape that carries an image developed by a developer such as toner. The photoreceptor roller 152K is uniformly charged by the charging device 154K, and an electrostatic latent image is formed on the photoreceptor roller 152K by laser light emitted by the exposure part 140K. The electrostatic latent image formed on the photoreceptor roller 152K is developed by a developer such as black (K) toner by the developing device 156K and is then transferred onto the intermediate transfer belt 16. Note that remaining toner, paper powder, and the like attached on the photoreceptor roller 152K after the toner image (developer image) transfer step are removed by the cleaning device 158K.

Similarly, the other image forming units 14C, 14M, and 14Y have photoreceptor rollers 152C, 152M, and 152Y and developing devices 156C, 156M, and 156Y, respectively, form toner images of cyan (C), magenta (N), and yellow (Y), respectively, and transfer the toner images of the respective colors onto the intermediate transfer belt 16.

The intermediate transfer belt 16 is suspended around a drive roller 164, idle rollers 165, 166, and 167, a backup roller 168, and an idle roller 169 so as to keep constant tension, and is driven to circulate at a predetermined speed in a direction indicated by arrow A when the drive roller 164 is driven to rotate by a driving motor (not illustrated). The intermediate transfer belt 16 is, for example, an endless belt formed by forming a synthetic resin film such as polyimide having flexibility into a band shape and connecting both ends of the band-shaped synthetic resin film, for example, by welding.

The intermediate transfer belt 16 is provided with first transfer rollers 162K, 162C, 162M, and 162Y at positions corresponding to the image forming units 14K, 14C, 14M, and 14Y, and toner images of the respective colors formed on the photoreceptor rollers 152K, 152C, 152M, and 152Y are transferred onto the intermediate transfer belt 16 by these first transfer rollers 162 so as to be superimposed on one another. Note that remaining toner attached to the intermediate transfer belt 16 is removed by a cleaning blade or a brush of a cleaning device 189 for belt provided on a downstream side relative to a second transfer position.

Density sensors 170 are provided close to the intermediate transfer belt 16. The density sensors 170 are density detection parts that detect a density of a toner image transferred onto the intermediate transfer belt 16. Although plural density sensors 170 are disposed in the present exemplary embodiment, specific positions of the density sensors 170 will be described later.

The sheet transport path 18 is provided with a paper feeding roller 181 that takes recording paper 32 out from the sheet tray 17, a first roller pair 182, a second roller pair 183, and a third roller pair 184 for sheet transport, and a registration roller 185 that transports the recording paper 32 to a second transfer position at a preset timing.

Furthermore, a second transfer roller 186 that is pressed against the backup roller 168 is disposed at the second transfer position on the sheet transport path 18, and the toner images of the respective colors transferred onto the intermediate transfer belt 16 so as to be superimposed on one another are second-transferred onto the recording paper 32 by pressing force and electrostatic force generated by the second transfer roller 186. The recording paper 32 on which the toner images of the respective colors have been transferred is transported to the fixing unit 19 by a transfer belt 187 and a transfer belt 188.

The fixing unit 19 melts toner and fixes the toner onto the recording paper 32 by performing heating treatment and pressing treatment on the recording paper 32 onto which the toner images of the respective colors have been transferred.

Note that the developing device 156K has a cylindrical development roller (developer transport part) 157K that rotates to transport a developer to the photoreceptor roller 152K and forms a developer image on the photoreceptor roller 152K. Similarly, in the image forming units 14C, 14M, and 14Y that form images of the other colors, each of developing devices 156C, 156M, and 156Y includes a development roller.

In the image forming apparatus 10 according to the present exemplary embodiment, an image is formed on a recording medium such as print paper by an electrophotographic system having the above configuration.

However, in the image forming apparatus 10 according to the present exemplary embodiment, an image is formed by using rotating members such the photoreceptor roller 152 and the development roller 157, and therefore periodical density unevenness (density fluctuation) occurs in a second scanning direction that is a paper transport direction in some cases.

Figure 2:
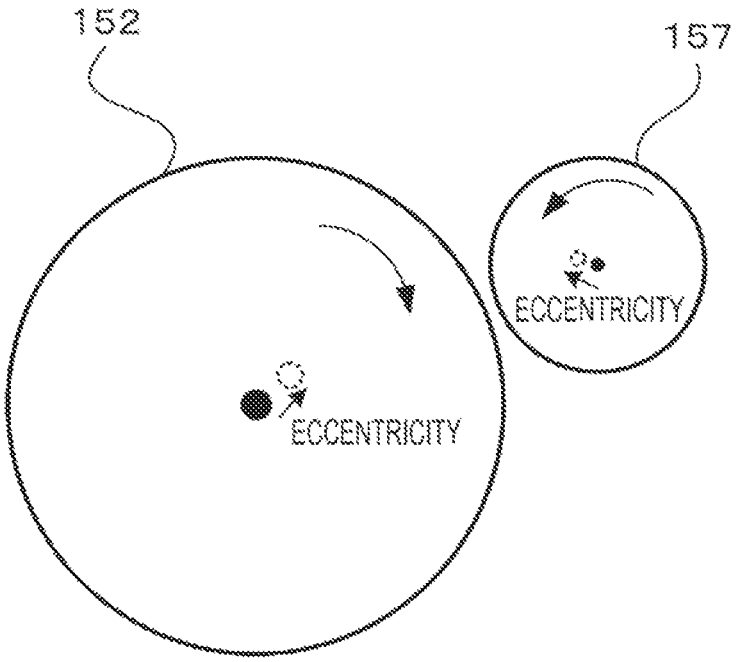
FIG. 2 illustrates a positional relationship between a photoreceptor roller and a development roller.

For example, FIG. 2 illustrates a positional relationship between the photoreceptor roller 152 and development roller 157.

As is clear from FIG. 2, the photoreceptor roller 152 and the development roller 157 face each other with a certain gap interposed therebetween. The development roller 157 holds a developer on a surface thereof due to magnetic force of a magnet provided therein, rotates to transport the developer held in the gap from the photoreceptor roller 152, and thereby develops an electrostatic latent image formed on the surface of the photoreceptor roller 152 into a visible image.

However, in a case where a rotary axis of the photoreceptor roller 152 and/or a rotary axis of the development roller 157 are deviated from an ideal rotary axis, the gap between the photoreceptor roller 152 and the development roller 157 periodically changes. Also in a case where the photoreceptor roller 152 and the development roller 157 are not completely parallel with each other, a similar problem occurs.

Figure 3A:
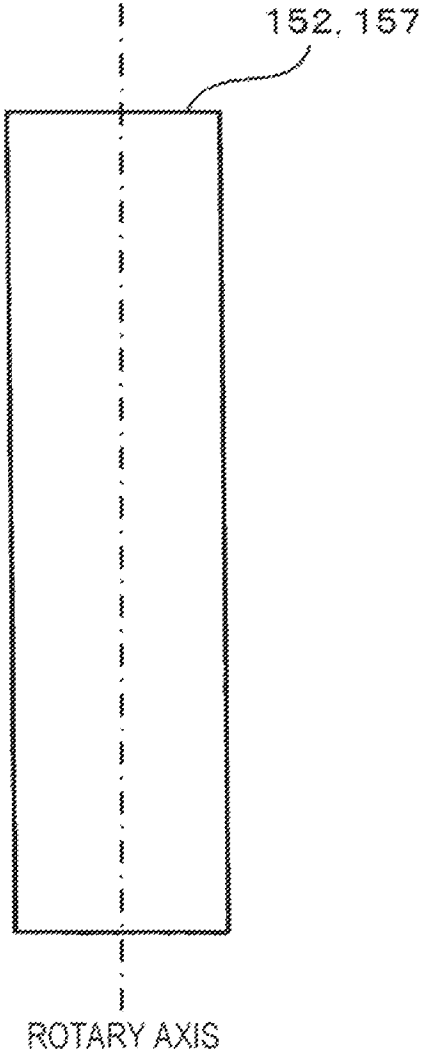
FIGS. 3A to 3C are views for explaining a case where a shape itself of the photoreceptor roller and/or a shape itself of the development roller are distorted or warped.
Figure 3B:
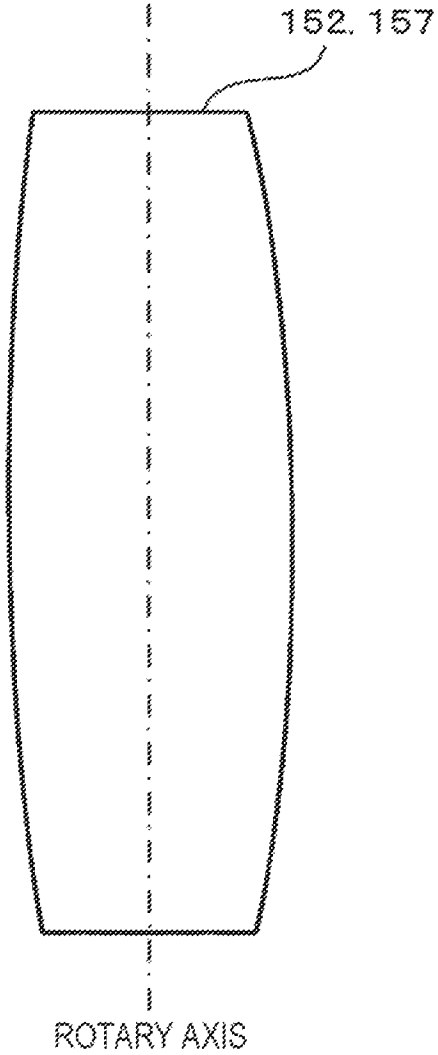
Figure 3C:
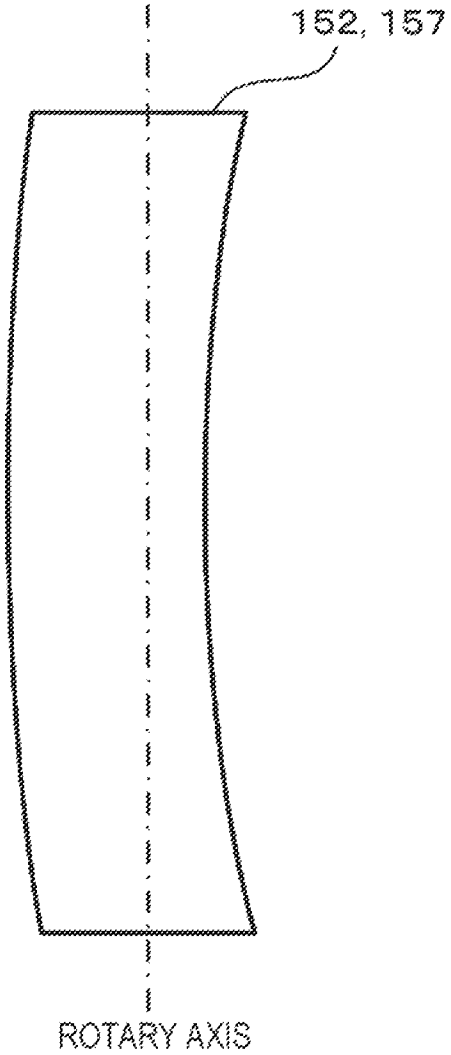

Furthermore, also in a case where a shape itself of the photoreceptor roller 152 and/or a shape itself of the development roller 157 are distorted or warped, a similar problem occurs. FIG. 3A illustrates a case where the photoreceptor roller 152 and the development roller 157 have an ideal shape. FIG. 3B illustrates a case where a central part of the photoreceptor roller 152 or the development roller 157 has a bulging shape as compared with end parts thereof, and FIG. 3C illustrates a state where the photoreceptor roller 152 or the development roller 157 is warped.

In some cases, periodical density unevenness occurs in a second scanning direction in a formed image due to such a cause.

Figure 4:
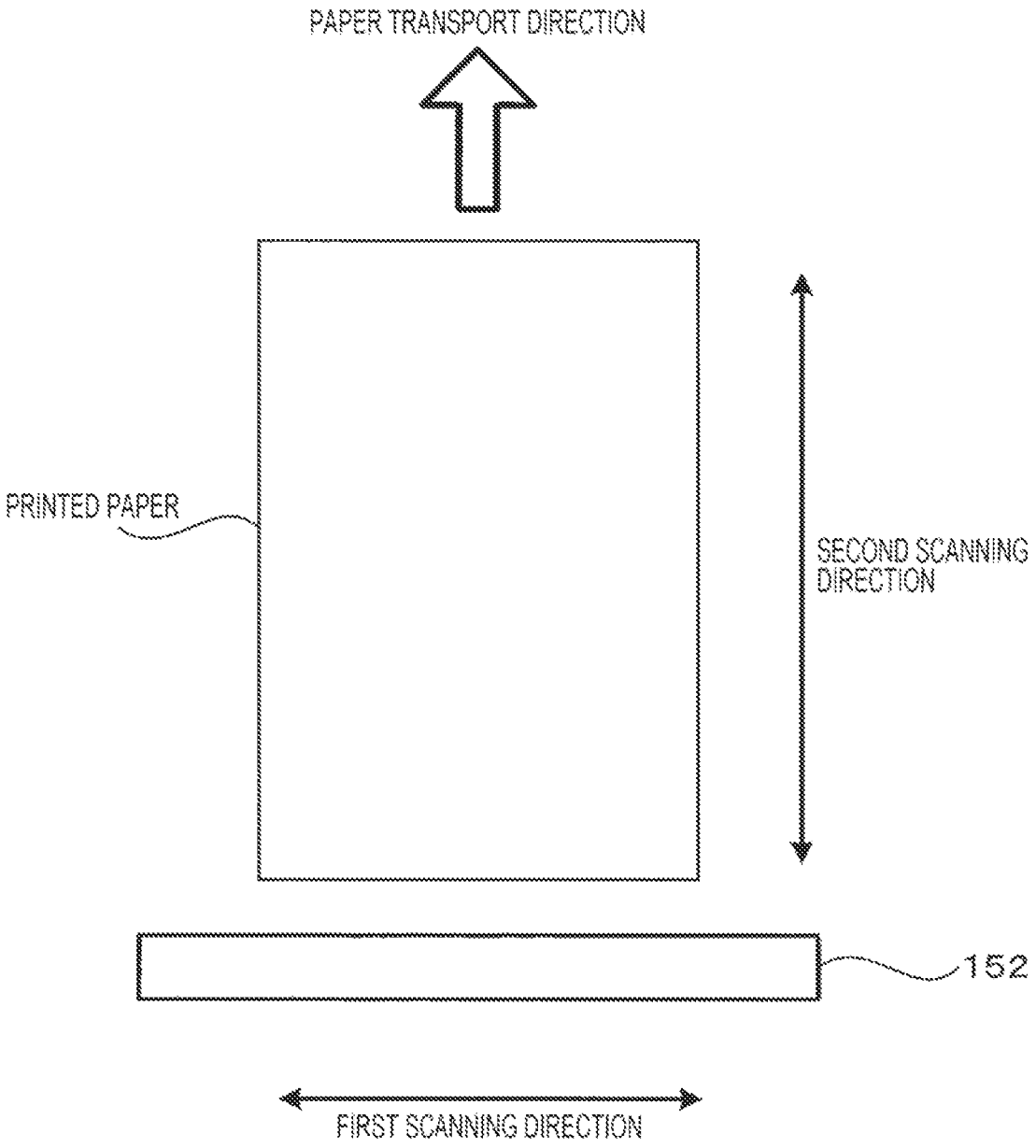
FIG. 4 is a view for explaining a formed image and names of directions in the image forming apparatus.

A formed image and names of directions in the image forming apparatus 10 are described with reference to FIG. 4. As illustrated in FIG. 4, a direction in which laser light is scanned by the exposure part 140, that is, a longitudinal direction of the photoreceptor roller 12 is referred to as a first scanning direction. A direction orthogonal to the first scanning direction, that is, a paper transport direction in which print paper or the like is transported is referred to as a second scanning direction.

Figure 5:
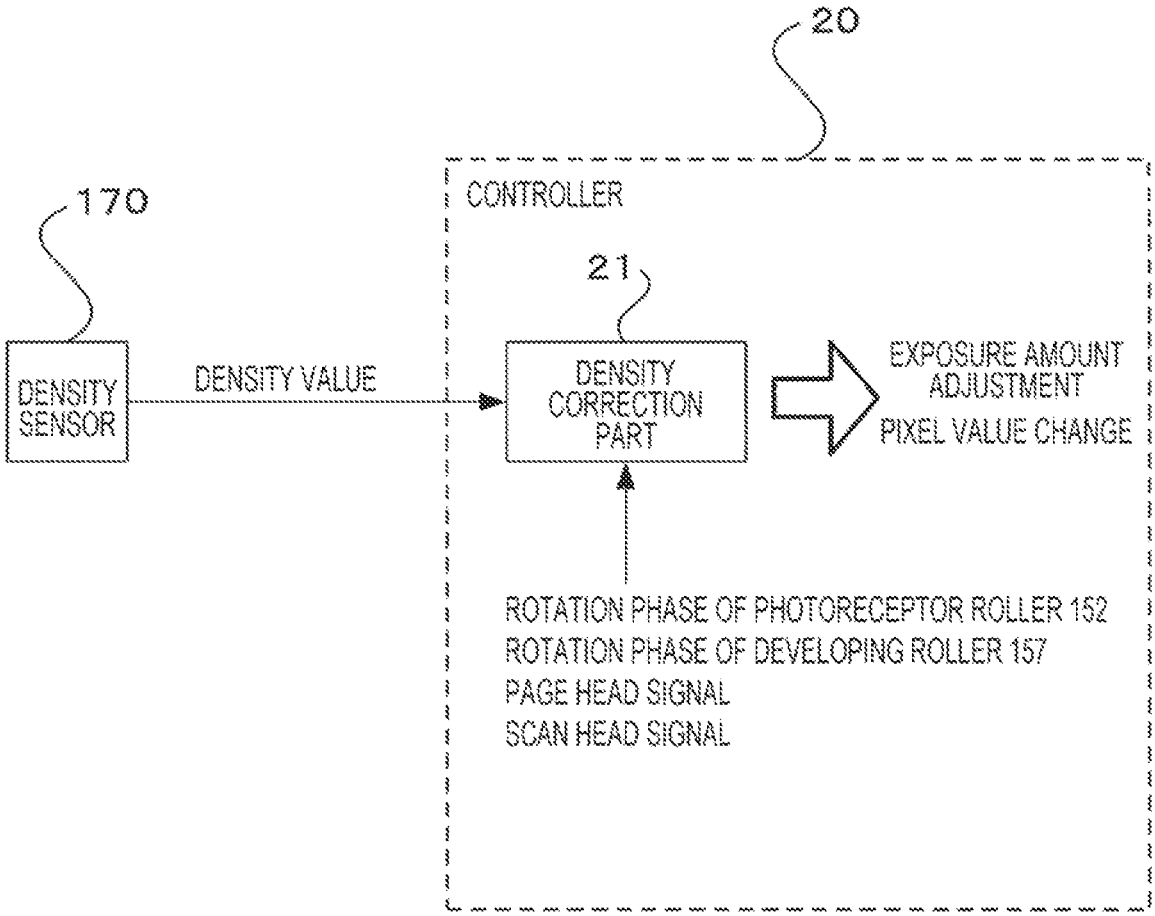
FIG. 5 is a view for explaining how a controller of the image forming apparatus according to the exemplary embodiment of the present disclosure performs density correction.

Next, how the controller 20 of the image forming apparatus 10 according to the present exemplary embodiment performs density correction is described with reference to FIG. 5.

As described above, the controller 20 performs control so that an image based on input image data is formed on a recording medium such as print paper. The controller 20 includes a density correction part 21 that performs density correction for reducing density unevenness of an image formed on a recording medium.

The density correction part 21 detects density unevenness in an output image on the basis of density information such as density values detected by the density sensors 170 and adjusts an exposure amount of the exposure part 140 or changes a pixel value for formation of an image so as to reduce the detected density unevenness. The density correction part 21 determines a position in the image where the density correction is to be performed on the basis of rotation phase information such as a Z-phase signal of the photoreceptor roller 152, rotation phase information such as a Z-phase signal of the development roller 157, a page head signal, and a scan head signal.

As described above, a cycle, a phase, and an amplitude of density unevenness that occurs due to eccentricity, distortion or warpage of a shape, or the like of the photoreceptor roller 152 and/or the development roller 157 vary depending on a position in the first scanning direction. In particular, in some cases, there is a large difference, for example, in degree of density unevenness between a central portion and an end portion in the first scanning direction.

In view of this, density unevenness is detected by using the plural density sensors 170 instead of providing only one density sensor 170 for detecting density unevenness.

Figure 6A:
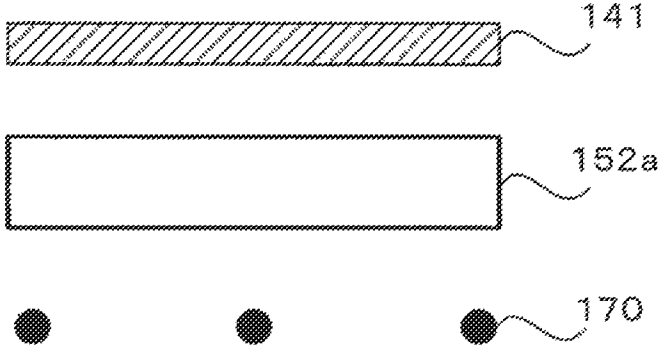
FIG. 6A illustrates a case where three density sensors are disposed for a single LPH in a printer that supports an A3 size.

For example, as illustrated in FIG. 6A, in a case of a printer that supports an A3 size, three density sensors 170 for density detection are provided for the photoreceptor roller 152*a* and one LPH 141 at three positions, that is, a central position and both end positions, respectively.

In a case where an LPH for A3 size is used for a printer that supports a large size that is longer than an A3 width in the first scanning direction, plural LPHs are disposed so that the entire width of the photoreceptor roller 152 is exposed to light.

For example, in the image forming apparatus 10 according to the present exemplary embodiment, the photoreceptor roller 152 is exposed to light by disposing three LPHs 141 to 143.

Each of the LPHs 141 to 143 is a light-emitting part in which plural LEDs are aligned, and the LPHs 141 to 143 are shifted from one another so as to face the photoreceptor roller 152, which is an image carrier, and are thus configured to expose the entire width of the photoreceptor roller 152 to light.

Figure 6B:
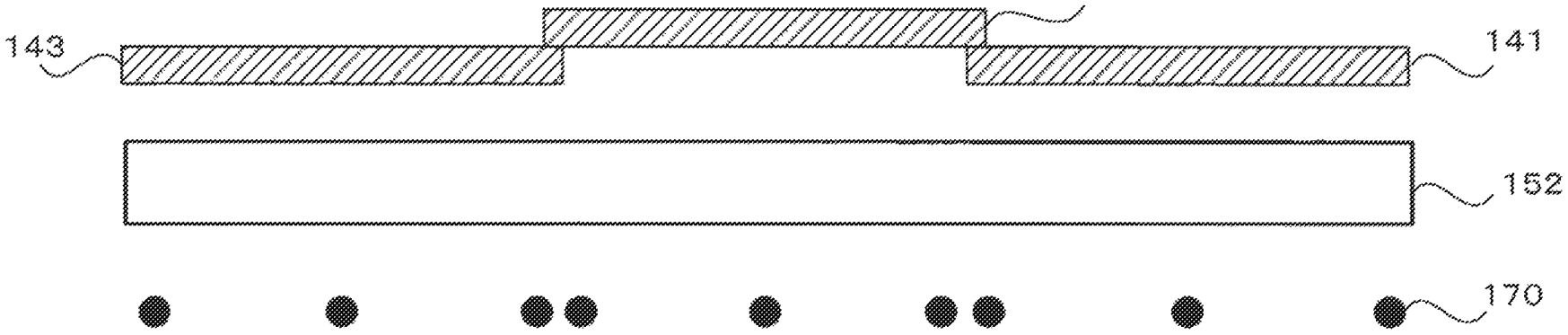
FIG. 6B illustrates a case where three density sensors are disposed for each LPH in a printer that supports a large size.

FIG. 6B illustrates a case where three density sensors 170 are disposed for each of the three LPHs 141 to 143.

As illustrated in FIG. 6B, in a case where three density sensors 170 are disposed for each LPH, nine density sensors 170 are needed in total. Thus disposing a lot of density sensors 170 invites an increase in cost of the image forming apparatus 10.

Figure 7:
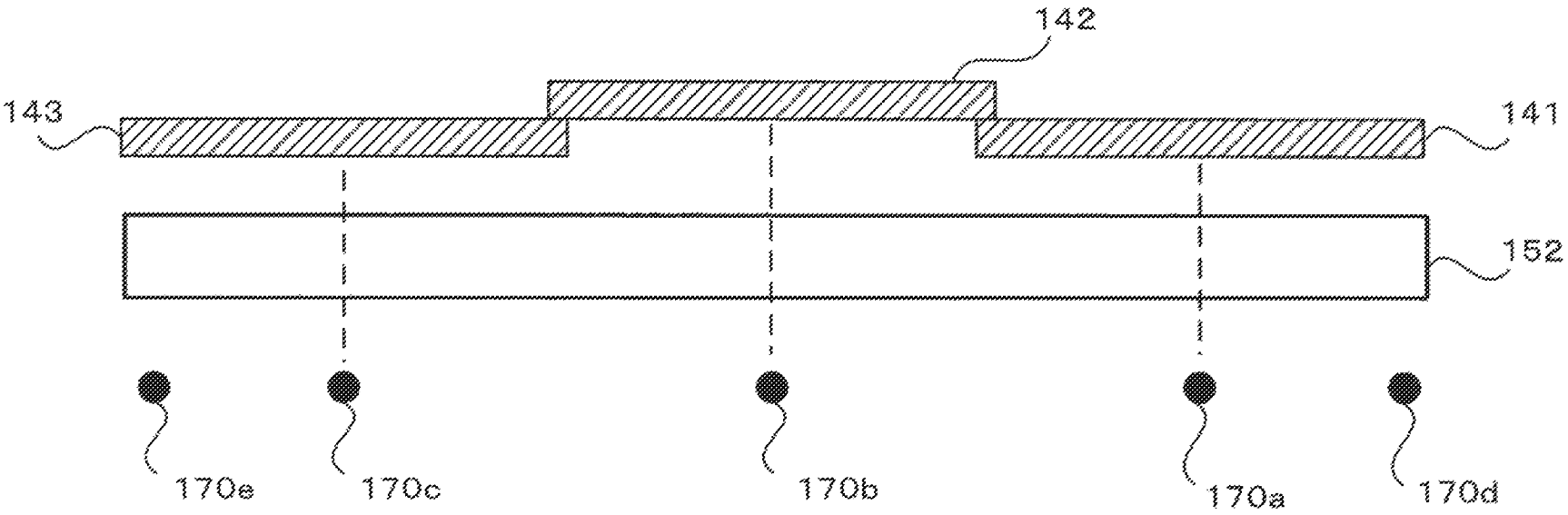
FIG. 7 is a view for explaining a positional relationship between the density sensors and LPHs according to the present exemplary embodiment.

In view of this, the density sensors 170 of the image forming apparatus 10 according to the present exemplary embodiment are disposed as illustrated in FIG. 7. FIG. 7 is a view for explaining a positional relationship between the density sensors 170 and the LPHs 141 to 143 according to the present exemplary embodiment.

In the image forming apparatus 10 according to the present exemplary embodiment, the exposure part 140 includes the three LPHs 141 to 143. In the image forming apparatus 10 according to the present exemplary embodiment, five density sensors 170*a* to 170*e* are disposed.

The five density sensors 170*a* to 170*e* are disposed to detect a density of an image obtained by developing an electrostatic latent image on the photoreceptor roller 152. The density sensors 170*a* to 170*c* are disposed at positions corresponding to substantially central positions of the three LPHs 141 to 143 that are light-emitting parts, respectively, and the density sensors 170*d* and 170*e* are disposed at positions corresponding to end portions closer to end portions of the photoreceptor roller 152 among end portions of the two LPHs 141 and 143 disposed close to the end portions of the photoreceptor roller 152 among the three LPHs 141 to 143.

A substantially central position of an LPH means a position within a range of 40% to 60% of a whole length of the LPH. An end portion of an object means a region in which a distance from an end of the object is within a range of 0% to 10% of a length of the object.

The density sensors 170*a* to 170*c* are disposed at centers of the LPHs 141 to 143, respectively, and therefore can detect density unevenness among the LPHs 141 to 143. The density sensors 170*d* and 170*e* are located so as to be capable of detecting density unevenness in end portions of the photoreceptor roller 152, that is, end portions of a formed image in the first scanning direction.

For example, in a case where the rotary axis of the photoreceptor roller 152 and/or the rotary axis of the development roller 157 are inclined or in a case where the rotary axis of the photoreceptor roller 152 and the rotary axis of the development roller 157 are not parallel, there is a possibility that density unevenness occurs in end portions of a formed image in the first scanning direction. Furthermore, in a case where the shape of the photoreceptor roller 152 and/or the shape of the development roller 157 are distorted or warped, there is a possibility that a density difference between a central portion and an end portion increases, and the density unevenness can be detected by comparing a density value of the density sensor 170*b* disposed in the central portion and density values of the density sensors 170*d* and 170*e* disposed in the end portions.

In a case where an odd number of LPHs are provided, the density correction part 21 performs tone correction for correcting an output density with respect to an input pixel value by using density information detected by a density sensor 170 disposed corresponding to a substantially central position of a central one of the plural LPHs.

For example, since the number of LPHs is three in the present exemplary embodiment, the density correction part 21 performs tone correction for correcting an output density with respect to an input pixel value by using density information detected by the density sensor 170*b*, which is a central one of the three LPHs 141 to 143.

This is because density information at a central position of a formed image in the first scanning direction is highly likely to represent a density of the whole image most, and therefore in a case where tone correction is performed by using a single piece of density information, it is highly likely that most appropriate tone correction can be performed by using density information of the density sensor 170*b* that detects a density at the center of the image.

Furthermore, the density correction part 21 performs density correction for reducing a density difference among LPHs by using density values detected by the density sensors 170*a* to 170*c* provided at positions corresponding to the substantially central positions of the three LPHs 141 to 143, respectively among the five density sensors 170*a* to 170*e*.

This is because the density values detected by the three density sensors 170*a* to 170*c* provided at positions corresponding to the substantially central positions of the three LPHs 141 to 143, respectively can be regarded as representing characteristics of the LPHs 141 to 143, respectively.

Furthermore, the density correction part 21 corrects a periodical density fluctuation in the second scanning direction orthogonal to the first scanning direction in which the exposure part 140 exposes the photoreceptor roller 152 to light by using density values detected by the five density sensors 170*a* to 170*e*.

As described above, the five density sensors 170*a* to 170*e* are disposed so as to detect a density of an image on the intermediate transfer belt 16 on which a developer image formed on the photoreceptor roller 152 is transferred.

Figure 8:
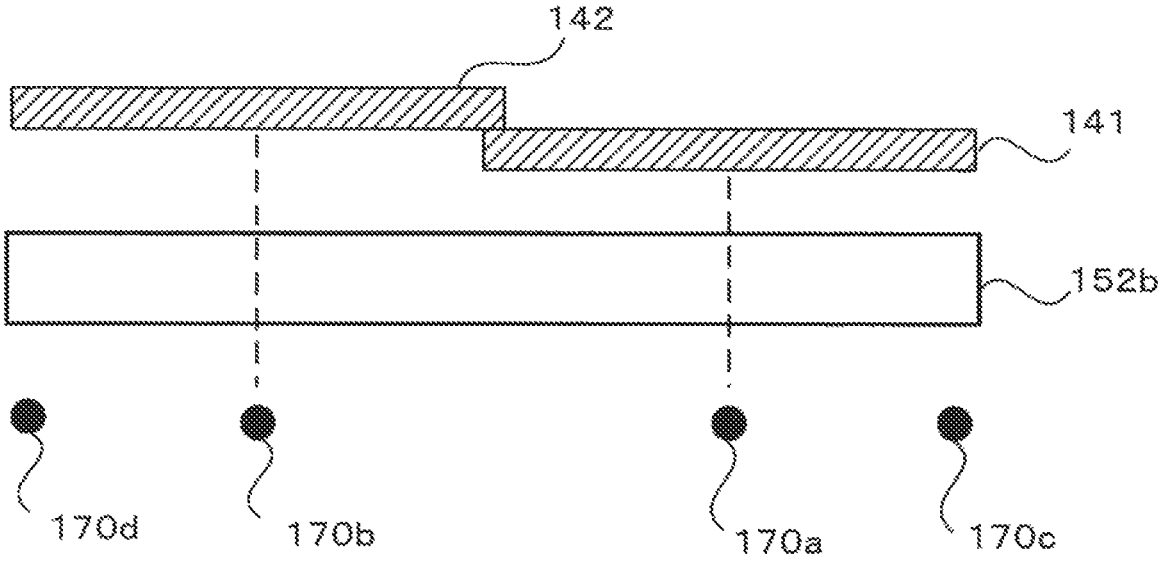
FIG. 8 illustrates an example of a way in which the density sensors are disposed in a case where an exposure part includes two LPHs.

Although a case where the exposure part 140 includes three LPHs has been described in FIG. 7, FIG. 8 illustrates an example of a way in which the density sensors 170 are disposed in a case where the exposure part 140 includes two LPHs. FIG. 8 illustrates a case where the exposure part 140 includes two LPHs 141 and 142.

In a case where the exposure part 140 includes the two LPHs 141 and 142, four density sensors 170*a* to 170*d* need just be disposed at positions corresponding to substantially central positions of the LPHs 141 and 142 and two positions corresponding to end portions of the two LPHs 141 and 142 that are closer to end portions of the photoreceptor roller 152*b*.

Specifically, the density sensors 170*a* and 170*b* are disposed corresponding to the substantially central positions of the LPHs 141 and 142, respectively, and the density sensors 170*c* and 170*d* are disposed at positions corresponding to the end portions of the photoreceptor roller 152*b*.

Figure 9:
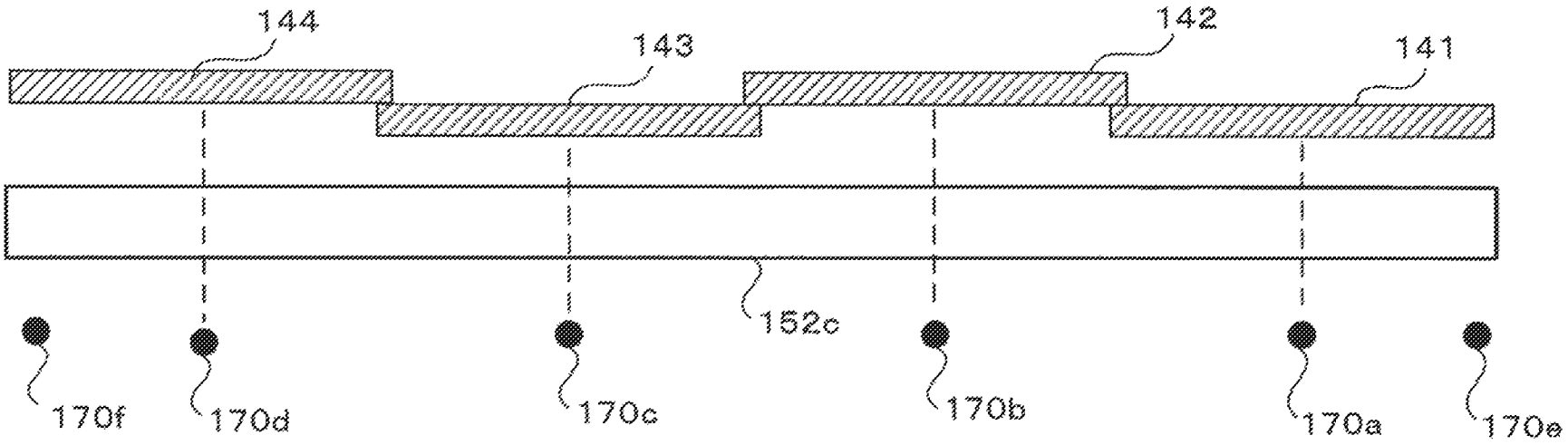
FIG. 9 illustrates an example of a way in which the density sensors are disposed in a case where the exposure part includes four LPHs.

Next, FIG. 9 illustrates an example of a way in which the density sensors 170 are disposed in a case where the exposure part 140 includes four LPHs. FIG. 9 illustrates a case where the exposure part 140 includes four LPHs 141 to 144.

In a case where the exposure part 140 includes the four LPHs 141 to 144, six density sensors 170*a* to 170*f* need just be disposed at positions corresponding to substantially central portions of the LPHs 141 to 144 and two positions corresponding to end portions closer to end portions of the photoreceptor roller 152*c* among end portions of the two LPHs 141 and 144 disposed close to the end portions of the photoreceptor roller 152*c*.

Specifically, the density sensors 170*a* to 170*d* are disposed corresponding to the substantially central positions of the LPHs 141 to 143, respectively, and the density sensors 170*e* and 170*f* are disposed at positions corresponding to the end portions of the photoreceptor roller 152*c*.

Figure 10:
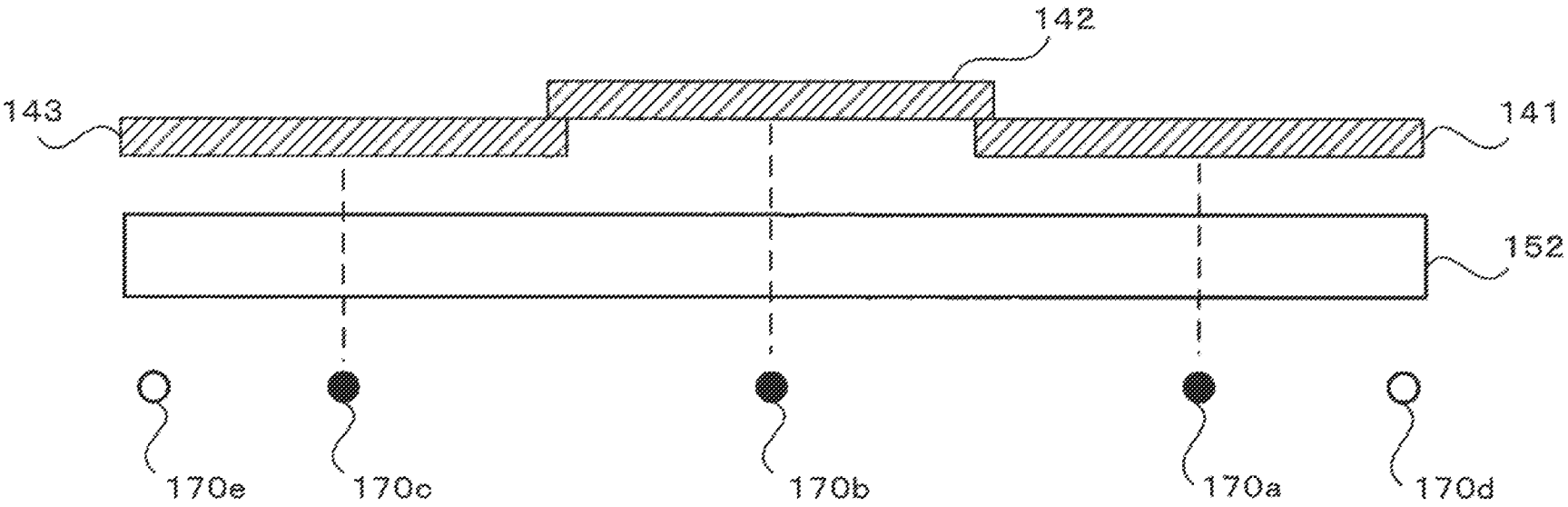
FIG. 10 illustrates an example of a way in which the density sensors are disposed in a case where two kinds of sensors that are different in performance are used as the five density sensors.

Note that although a case where all of the five density sensors 170*a* to 170*e* are equal in performance has been described in the example illustrated in FIG. 7, FIG. 10 illustrates an example of a way in which two kinds of density sensors 170 that are different in performance are used.

In the example illustrated in FIG. 10, the density sensors 170*a* to 170*d* disposed at positions corresponding to the substantially central positions of the three LPHs 141 to 143, respectively among the five density sensors 170*a* to 170*e* are configured to be capable of receiving specular reflection light and diffuse reflection light of an image to be measured. The density sensors 170*d* and 170*e* disposed at positions corresponding to the end portions closer to the end portions of the photoreceptor roller 152 among end portions of the two LPHs 141 and 143 disposed close to the end portions of the photoreceptor roller 152 among the five density sensors 170*a* to 170*e* are configured to be capable of receiving only specular reflection light of an image to be measured.

In general, a cost of a sensor that is configured to be capable of receiving both specular reflection light and diffuse reflection light is higher than a cost of a sensor that is configured to be capable of receiving only specular reflection light.

The three density sensors 170*a* to 170*c* disposed at positions corresponding to the substantially central positions of the LPHs 141 to 143, respectively are also used to reduce a density variation among the LPHs 141 to 143 and correct tone characteristics and are therefore required to correctly detect an absolute density value.

Meanwhile, the two density sensors 170*d* and 170*e* that are disposed at positions corresponding to the end portions of the photoreceptor roller 152 need just detect density unevenness in the second scanning direction and therefore can accomplish their objectives as long as they can detect a relative density change.

In view of this, sensors of a low cost are used as the two density sensors 170*d* and 170*e* disposed at positions corresponding to the end portions of the photoreceptor roller 152, and sensors of a high cost are used as the three density sensors 170*a* to 170*c* disposed at positions corresponding to the substantially central positions of the LPHs 141 to 143.

By thus disposing the density sensors, a total cost can be reduced as compared with a case where all of the density sensors 170*a* to 170*e* are sensors of a high cost.

Figure 11:
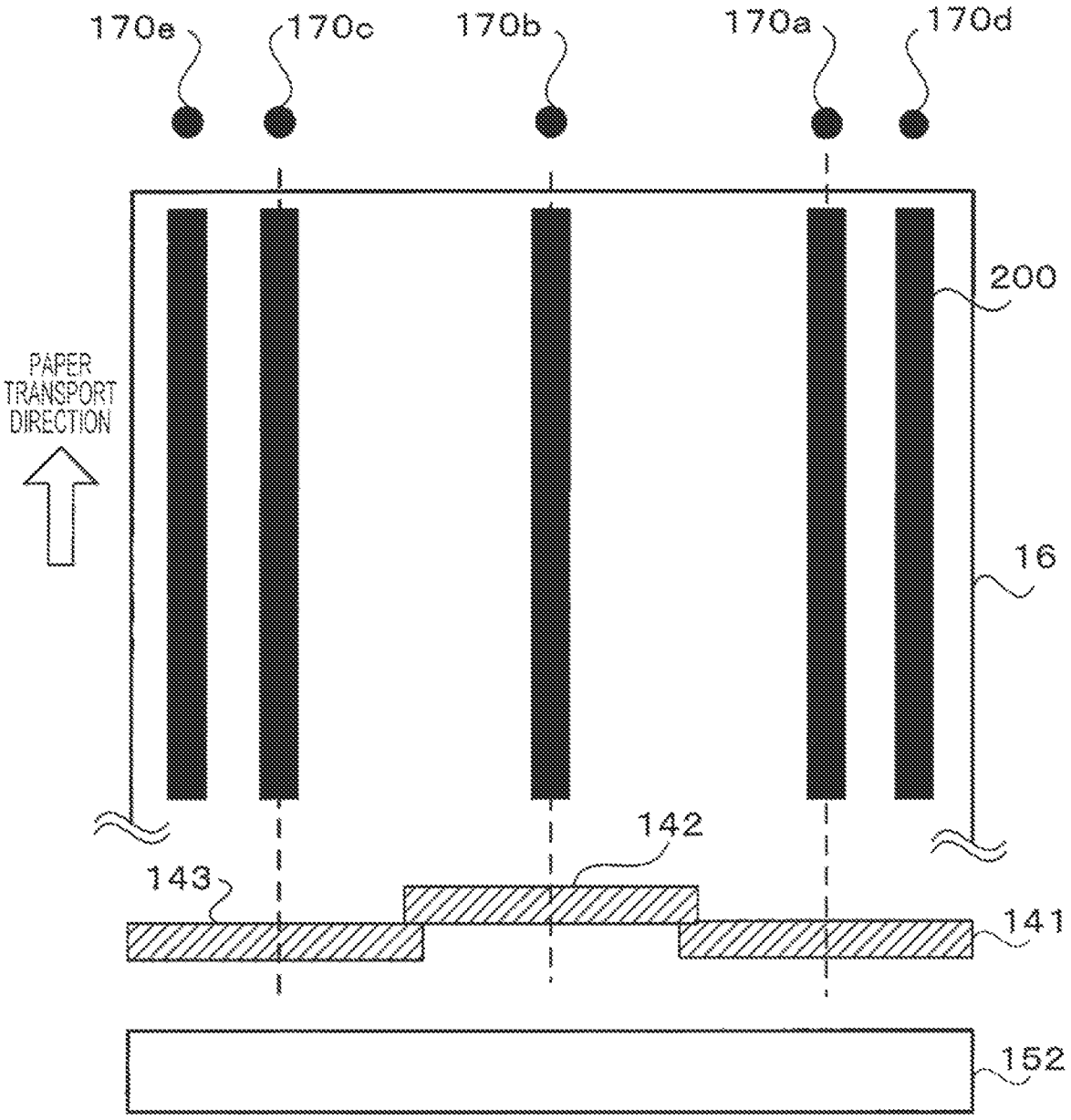
FIG. 11 illustrates an example of a configuration of patch images for inspection for detecting density unevenness in a case where the five density sensors are disposed.

Next, FIG. 11 illustrates an example of a configuration of patch images for inspection 200 for detection of density unevenness in a case where the density sensors are disposed in the state described above.

As illustrated in FIG. 11, the patch images for inspection 200, which are inspection images for detecting density unevenness, are formed corresponding to the positions where the density sensors 170*a* to 170*d* are disposed.

In a case where such patch images for inspection 200 are formed, the controller 20 performs control so that the plural patch images for inspection 200 having the same density are formed continuously in the second scanning direction orthogonal to the first scanning direction at positions corresponding to the substantially central portions of the three LPHs 141 to 143 and at positions corresponding to end portions closer to the end portions of the photoreceptor roller 152 among the end portions of the two LPHs 141 and 143 disposed close to the end portions of the photoreceptor roller 152 among the three LPHs 141 to 143 in the first scanning direction in which the exposure part 140 exposes the photoreceptor roller 152 to light.

Although a case where solid images having the same density and having a maximum density are formed as the patch images for inspection 200 is illustrated in FIG. 11, not only an image having a maximum density, but also a halftone image may be formed as the patch images for inspection 200.

For example, in a case where tone characteristics, which are characteristics of a density of an output image with respect to an input pixel value, are to be adjusted, it is necessary to measure density values by using the density sensors 170 by forming not only an image having a maximum density but also a halftone image.

Although the patch images for inspection 200 are formed only at positions corresponding to the positions where the density sensors 170*a* to 170*d* are disposed in FIG. 11, density detection can also be performed even in a case where an image having a uniform density is formed throughout the entire width in the first scanning direction. However, in a case where an image having a uniform density is formed throughout the entire width in the first scanning direction, toner consumption becomes large, and toner formed in portions other than portions where density detection is performed is wasted. Therefore, by forming the patch images for inspection 200 only at positions corresponding to the positions where the density sensors 170*a* to 170*d* are disposed as illustrated in FIG. 11, toner consumption is decreased.

Figure 12:
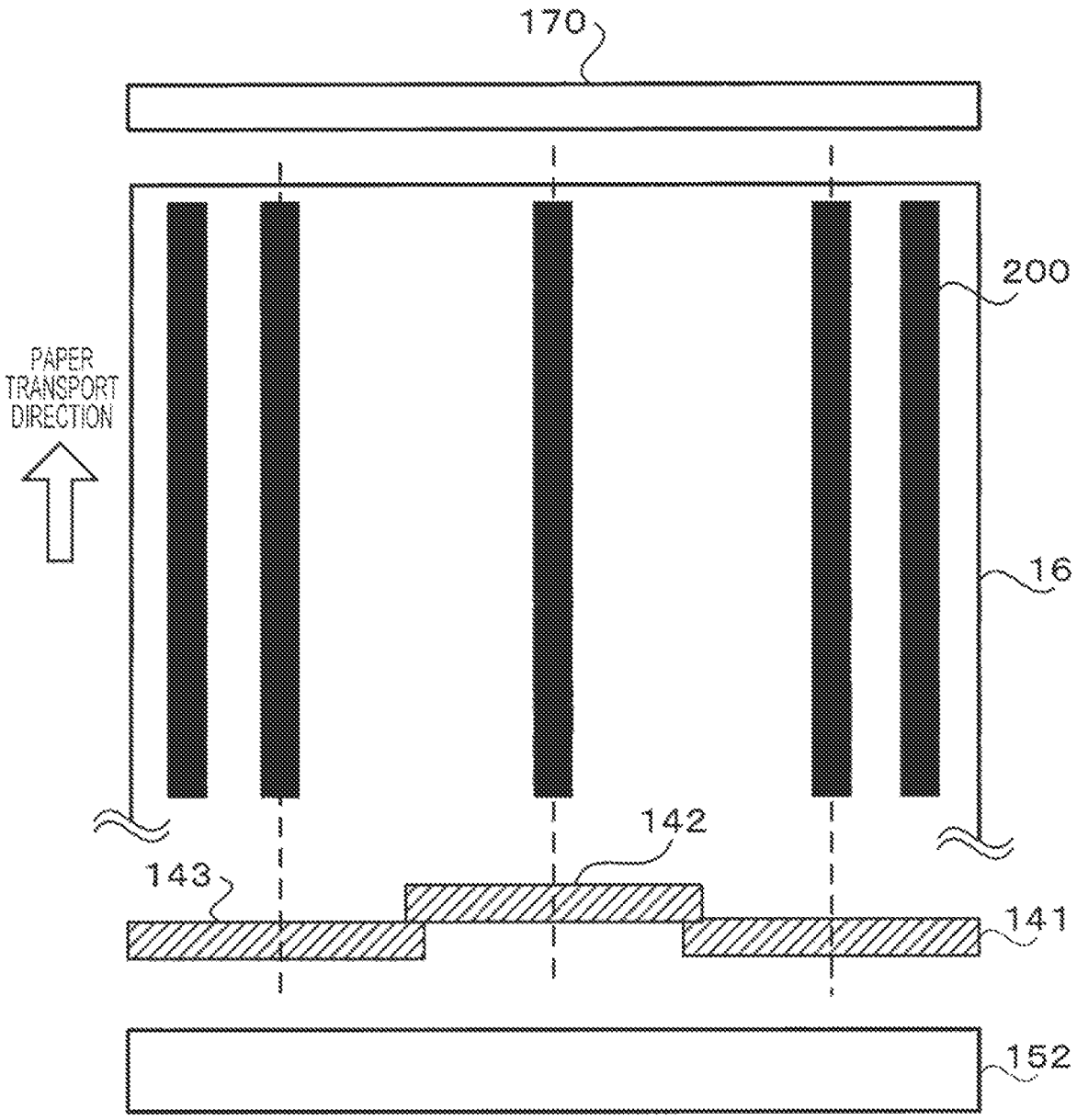
FIG. 12 is a view for explaining a case where patch images for inspection are formed only in places where a density value is to be detected in a case where an in-line type density sensor is used.

Also in a case where an in-line type density sensor 170 is used instead of the density sensors 170*a* to 170*d* as illustrated in FIG. 12, toner consumption can be minimized by forming the patch images for inspection 200 only in places where a density value is to be detected.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. An image forming apparatus comprising:

an image carrier that carries an image developed by a developer;

an exposure part that has a plurality of light-emitting parts that are shifted from one another so as to face the image carrier and in each of which a plurality of light-emitting elements are aligned and forms an electrostatic latent image on the image carrier by exposing the image carrier to light; and a plurality of density detection parts that are disposed at positions corresponding to substantially central positions of the plurality of light-emitting parts and at positions corresponding to end portions closer to end portions of the image carrier among end portions of two light-emitting parts disposed close to the end portions of the image carrier among the plurality of light-emitting parts and detect a density of an image obtained by developing the electrostatic latent image on the image carrier.

2. The image forming apparatus according to claim 1, further comprising a correction part that performs tone correction for correcting an output density with respect to an input pixel value by using density information detected by a density detection part disposed corresponding to a substantially central position of a central one of the plurality of light-emitting parts in a case where an odd number of light-emitting parts are provided.

3. The image forming apparatus according to claim 2, wherein:

the correction part performs density correction for reducing a density difference among the light-emitting parts by using density information detected by density detection parts provided at positions corresponding to the substantially central positions of the plurality of light-emitting parts among the plurality of density detection parts.

4. The image forming apparatus according to claim 3, wherein:

the correcting part corrects a periodical density fluctuation in a second scanning direction orthogonal to a first scanning direction in which the exposure part exposes the image carrier to light by using density information detected by the plurality of density detection parts.

5. The image forming apparatus according to claim 4, wherein:

density detection parts disposed at positions corresponding to the substantially central positions of the plurality of light-emitting parts among the plurality of density detection parts are configured to be capable of receiving specular reflection light and diffuse reflection light of an image to be measured; and density detection parts disposed at positions corresponding to the end portions closer to the end portions of the image carrier among the end portions of the two light-emitting parts disposed close to the end portions of the image carrier among the plurality of density detection parts are configured to be capable of receiving only diffuse reflection light of an image to be measured.

6. The image forming apparatus according to claim 4, wherein:

the plurality of density detection parts are disposed so as to detect a density of an image on an intermediate transfer body onto which a developer image formed on the image carrier is transferred.

7. The image forming apparatus according to claim 3, wherein:

density detection parts disposed at positions corresponding to the substantially central positions of the plurality of light-emitting parts among the plurality of density detection parts are configured to be capable of receiving specular reflection light and diffuse reflection light of an image to be measured; and density detection parts disposed at positions corresponding to the end portions closer to the end portions of the image carrier among the end portions of the two light-emitting parts disposed close to the end portions of the image carrier among the plurality of density detection parts are configured to be capable of receiving only diffuse reflection light of an image to be measured.

8. The image forming apparatus according to claim 7, wherein:

the plurality of density detection parts are disposed so as to detect a density of an image on an intermediate transfer body onto which a developer image formed on the image carrier is transferred.

9. The image forming apparatus according to claim 3, wherein:

the plurality of density detection parts are disposed so as to detect a density of an image on an intermediate transfer body onto which a developer image formed on the image carrier is transferred.

10. The image forming apparatus according to claim 2, wherein:

the correcting part corrects a periodical density fluctuation in a second scanning direction orthogonal to a first scanning direction in which the exposure part exposes the image carrier to light by using density information detected by the plurality of density detection parts.

11. The image forming apparatus according to claim 10, wherein:

density detection parts disposed at positions corresponding to the substantially central positions of the plurality of light-emitting parts among the plurality of density detection parts are configured to be capable of receiving specular reflection light and diffuse reflection light of an image to be measured; and density detection parts disposed at positions corresponding to the end portions closer to the end portions of the image carrier among the end portions of the two light-emitting parts disposed close to the end portions of the image carrier among the plurality of density detection parts are configured to be capable of receiving only diffuse reflection light of an image to be measured.

12. The image forming apparatus according to claim 11, wherein:

the plurality of density detection parts are disposed so as to detect a density of an image on an intermediate transfer body onto which a developer image formed on the image carrier is transferred.

13. The image forming apparatus according to claim 10, wherein:

the plurality of density detection parts are disposed so as to detect a density of an image on an intermediate transfer body onto which a developer image formed on the image carrier is transferred.

14. The image forming apparatus according to claim 2, wherein:

density detection parts disposed at positions corresponding to the substantially central positions of the plurality of light-emitting parts among the plurality of density detection parts are configured to be capable of receiving specular reflection light and diffuse reflection light of an image to be measured; and density detection parts disposed at positions corresponding to the end portions closer to the end portions of the image carrier among the end portions of the two light-emitting parts disposed close to the end portions of the image carrier among the plurality of density detection parts are configured to be capable of receiving only diffuse reflection light of an image to be measured.

15. The image forming apparatus according to claim 14, wherein:

the plurality of density detection parts are disposed so as to detect a density of an image on an intermediate transfer body onto which a developer image formed on the image carrier is transferred.

16. The image forming apparatus according to claim 2, wherein:

the plurality of density detection parts are disposed so as to detect a density of an image on an intermediate transfer body onto which a developer image formed on the image carrier is transferred.

17. The image forming apparatus according to claim 1, wherein:

density detection parts disposed at positions corresponding to the substantially central positions of the plurality of light-emitting parts among the plurality of density detection parts are configured to be capable of receiving specular reflection light and diffuse reflection light of an image to be measured; and density detection parts disposed at positions corresponding to the end portions closer to the end portions of the image carrier among the end portions of the two light-emitting parts disposed close to the end portions of the image carrier among the plurality of density detection parts are configured to be capable of receiving only diffuse reflection light of an image to be measured.

18. The image forming apparatus according to claim 17, wherein:

the plurality of density detection parts are disposed so as to detect a density of an image on an intermediate transfer body onto which a developer image formed on the image carrier is transferred.

19. The image forming apparatus according to claim 1, wherein:

the plurality of density detection parts are disposed so as to detect a density of an image on an intermediate transfer body onto which a developer image formed on the image carrier is transferred.

20. An image forming apparatus comprising:

an image carrier that carries an image developed by a developer;

an exposure part that has a plurality of light-emitting parts that are shifted from one another so as to face the image carrier and in each of which a plurality of light-emitting elements are aligned and forms an electrostatic latent image on the image carrier by exposing the image carrier to light; and a controller that performs control so that a plurality of inspection images having a same density are formed continuously in a second scanning direction orthogonal to a first scanning direction in which the exposure part exposes the image carrier to light at positions corresponding to substantially central positions of the plurality of light-emitting parts and at positions corresponding to end portions closer to end portions of the image carrier among end portions of two light-emitting parts disposed close to the end portions of the image carrier among the plurality of light-emitting parts in the first scanning direction.

* * * * *